United States Patent [19]

Sakai et al.

[11] Patent Number: 4,574,186

[45] Date of Patent: Mar. 4, 1986

[54] HEATING SHEET

[75] Inventors: Yoshio Sakai, Ueda; Takeshi Yamada, Saku, both of Japan

[73] Assignee: Totoku Electric Co., Ltd., Tokyo, Japan

[21] Appl. No.: 478,492

[22] Filed: Mar. 24, 1983

[30] Foreign Application Priority Data

Apr. 6, 1982 [JP] Japan ..... 57-49566[U]

[51] Int. Cl.[4] ..... H05B 3/36

[52] U.S. Cl. ..... 219/528; 219/345; 219/549; 338/212

[58] Field of Search ..... 219/213, 217, 345, 528, 219/543, 548, 549; 338/210, 212, 308, 309

[56] References Cited

U.S. PATENT DOCUMENTS

| | | | |
|---|---|---|---|
| 3,213,521 | 10/1965 | Owers | 219/528 X |
| 3,215,574 | 11/1965 | Korb | 219/549 X |
| 3,423,574 | 1/1969 | Shomphe et al. | 219/528 |
| 3,539,767 | 11/1970 | Eisler | 219/213 |
| 3,584,198 | 6/1971 | Doi et al. | 219/549 |
| 3,749,886 | 7/1973 | Michaelsen | 219/528 |
| 4,220,848 | 9/1980 | McMullan et al. | 219/528 |
| 4,293,763 | 10/1981 | McMullan | 219/528 |

FOREIGN PATENT DOCUMENTS

| | | | |
|---|---|---|---|
| WO82/00935 | 3/1982 | PCT Int'l Appl. | 219/548 |

*Primary Examiner*—Volodymyr Y. Mayewsky
*Attorney, Agent, or Firm*—Oblon, Fisher, Spivak, McClelland & Maier

[57] ABSTRACT

A heating sheet is provided in which protective covers are laminated to both surfaces of a heating element in which plastic sheets are respectively formed on the two surfaces of a metal foil heating circuit. The protective covers are adhered to the heater element such that indentations or recesses may be formed in those portions of the protective covers which do not correspond to the heating circuit.

2 Claims, 2 Drawing Figures

HEATING SHEET

BACKGROUND OF THE INVENTION

The present invention relates to an improvement in a structure of a heating sheet, in which protective covers are formed on both surfaces of a sheet-like heater element and the periphery thereof is bonded.

A conventional heating sheet is known in which protective covers are arranged at both surfaces of a sheet-like heater element and the periphery thereof is bonded. However, in a conventional heating sheet of this type, the position of the heater element sandwiched between the protective covers cannot be seen from the outside. This results in inconvenience when the heating sheet is to be mounted on equipment such that the heater element will not contact such equipment.

SUMMARY OF THE INVENTION

The present invention has been made to provide a heating sheet which eliminates the above problem with the conventional heating sheet, which may be easily mounted on equipment, and which does not trap air bubbles or voids therein.

In order to achieve the above and other objects, there is provided according to the present invention a heating sheet comprising a heater element which is obtained by forming a metal foil heating circuit on one surface of a plastic sheet, superposing another plastic sheet of the same shape as the former plastic sheet thereover, and adhering the two plastic sheets together; through holes formed in a regular pattern in portions of said heater element other than portions having said metal foil heating circuit formed therein; and a pair of protective covers which clamp said heater element therebetween at two surfaces thereof and which are bonded together along a periphery of said heating sheet which surrounds said through holes and said heater element, wherein positions of said through holes formed in said heater element may be apparent corresponding to an indentation pattern on the surfaces of said protective covers.

DETAILED DESCRIPTION OF THE PREFERRED EMBODIMENTS

Figure 1:
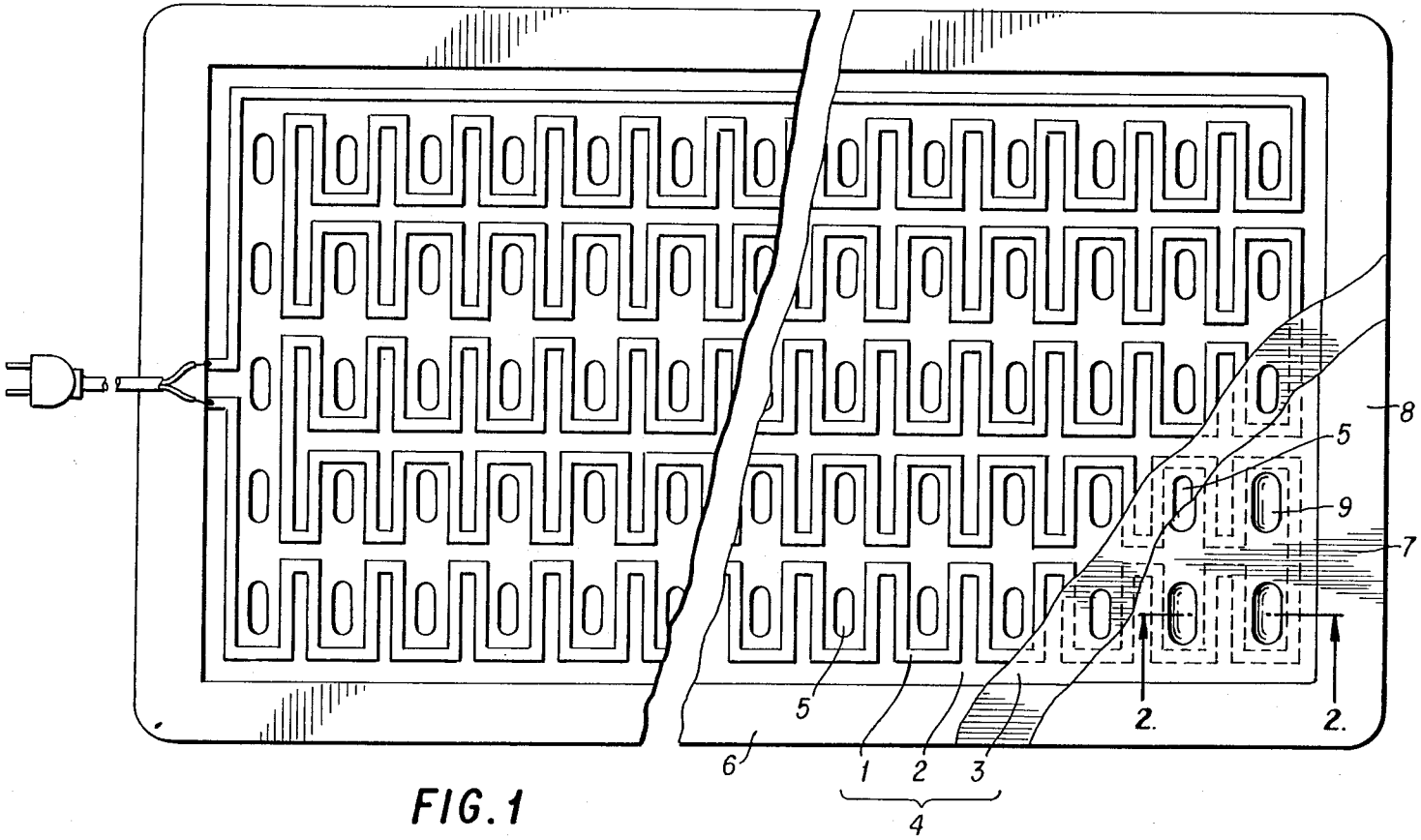
FIG. 1 is a partially cutaway plan view of a heating sheet according to an embodiment of the present invention.
Figure 2:
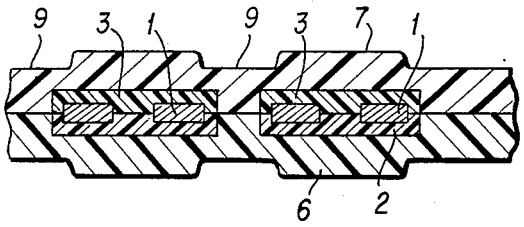
FIG. 2 is an enlarged sectional view taken along the line II—II in FIG. 1.

FIG. 1 is a plan view showing a heating sheet according to an embodiment of the present invention, with part thereof being cutaway. Referring to FIG. 1, an aluminum foil heating circuit 1 (e.g., 15 μm thickness) is formed in a predetermined pattern on one surface of a plastic sheet 2 (e.g., 75 μm thickness) of a thermoplastic resin such as PVC, polyester or the like. The aluminum foil heating circuit 1 is formed on a single consecutive strip of aluminum foil to provide an electric heating circuit. Electric thermal contacts are provided at the end of the aluminum foil to enable the aluminum foil to be electrically connected to an external power source. Another plastic sheet 3 (e.g., ⅜ μm thickness) of the same shape as the former plastic sheet and similarly consisting of PVC, polyester or the like is securely adhered on the heating circuit 1. The plastic sheets 2 and 3 and the heating circuit 1 together constitute a heater element 4. Through holes 5 (e.g., of elliptical shape having a minor axis of 4 mm and a major axis of 8 to 24 mm) are formed in a regular pattern on those portions of the heater element 4 which do not have the heating circuit 1 formed therein. The heater element 4 is securely held between a pair of relatively thin protective covers 6 and 7 (e.g., 0.4 mm) comprising a thermopastic resin such as PVC, polyester or the like. The protective covers 6 and 7 are hot-pressed from both outer surfaces for air-tight insulation. Thus, the upper and lower protective covers 6 and 7 are bonded together through the through holes 5 formed in the heater element 4. In addition, the periphery of a resulting heating sheet 8 is bonded and compressed under heat, with the internal air being expelled. In this case, since the protective covers 6 and 7 are relatively thin, they easily flex during hot pressing against the shape of the heater element. Thus, the positions of the through holes 5 formed in the heater element 4 appear as indentations or recesses 9 on the outer surfaces of the protective covers 6 and 7, respectively. Furthermore, formation of undesirable indentations due to trapped air bubbles or voids, which frequently occurs in conventional heating sheets, can be prevented.

According to the heating sheet of the present invention, the positions of the through holes 5 formed in the heater element 4 are clearly apparent corresponding to the recesses 9 on the surfaces of the heating sheet after hot-pressing the protective covers. For this reason, the positions of the heating circuit portions and the non-heating circuit portions may be easily distinguished, so that the heating sheet may be easily mounted on equipment at the positions of the recesses 9. Positioning of the heating sheet of the present invention may be easily performed for good outer appearance. Furthermore, the heating sheet of the present invention is free from formation of undesirable indentations due to trapped air bubbles or voids. According to the CSA standards, any electric equipment piece must have a shielding layer on the outer surface of a conductive portion so as to prevent an electric shock from occurring. According to the heating sheet of the present invention, shield plates having through holes arranged in the same pattern as those in the heater element may be arranged at both surfaces of the heater element. Then, protective covers are superposed on the outer surfaces of the shield plates and are hot-pressed, thus providing a heating sheet having an excellent shielding effect.

What is claimed is:

1. A heating sheet comprising a heater element which is obtained by forming a metal foil heating circuit on one surface of a first plastic sheet and superposing a second plastic sheet of the same shape as said first plastic sheet thereover, and adhering said first and second plastic sheets together; through holes formed in a regular pattern in portions of said heater element other than portions having said metal foil heating circuit formed therein; and a pair of protective thermoplastic covers which clamp said heater element therebetween and which are bonded together at a periphery of said heating sheet and through said through holes; wherein those portions of said protective covers which correspond to said through holes are recessed and indented due to said through holes in said heater element, thereby distinguishing the locations of said through holes.

2. A heating sheet according to claim 1, wherein said protective covers have a thickness of 0.4 mm.

* * * * *